United States Patent [19]

Clark et al.

[11] 4,269,205

[45] May 26, 1981

[54] THUMB HAIR GAUGE

[76] Inventors: Carl A. Clark; Kathleen J. Clark, both of 701 Broadway, #2, Galveston, Tex. 77550

[21] Appl. No.: 85,946

[22] Filed: Oct. 18, 1979

[51] Int. Cl.[3] ..... A45D 24/36

[52] U.S. Cl. ..... 132/45 R

[58] Field of Search .....132/45 R, 45 A

[56] References Cited

U.S. PATENT DOCUMENTS 3,125,101 3/1964 Clark ..... 132/45 R

FOREIGN PATENT DOCUMENTS 560041 6/1923 France ..... 132/45 A

*Primary Examiner*—G. E. McNeill

*Attorney, Agent, or Firm*—Jacobi, Lilling, Siegel & Presta

[57] ABSTRACT

An adjustable height gauge for use in hair cutting. The gauge is worn on the thumb, much like a ring, and includes a platform of adjustable height that supports the index finger of the same hand. The index finger and middle finger are used to grasp a section of hair and then the gauge is placed under the index finger in contact with the scalp and hair extending beyond the fingers is cut off. This device allows a person to cut his or her own hair by feel to any desired series of lengths for shaping and grooming.

7 Claims, 3 Drawing Figures

THUMB HAIR GAUGE

BACKGROUND OF THE INVENTION

Getting a haircut used to be a social occasion as well as a necessity in presenting a groomed appearance. With the rapidly escalating cost of haircuts and the demise of the neighborhood barber shop as a social hangout, getting a haircut has become an expensive necessity. With longer, less rigidly defined hairstyles of today, more and more women, and especially men, are cutting their own and/or their family's hair both for convenience and economy.

Cutting one's own hair has previously been a virtual impossibility to accomplish with any reasonable degree of satisfactory results. Much of the head is out of sight of a single mirror and, with a pair of mirrors, back and front, the disorientation of trying to make a particular length of cut to a particular portion of hair, while observing through the multiple reversing mechanism of two mirrors, is of such a degree of difficulty as to cause virtually anyone trying the maneuver to give up or present the appearance of being barbered by an erratic lawn mower.

Several accessories have previously been made available to assist people in cutting their own or their family's hair with a reasonable expectation of success without extensive training. Electric hair clippers, for instance, may be equipped with various depths of combs and hair cutting gauges as disclosed in U.S. Pat. No. 2,727,522 to Gomme. None of the accessories presently available or known are sufficiently easy to use or flexible enough in adjustment or method of use to produce satisfactory results, especially in cutting one's own hair.

SUMMARY OF THE INVENTION

The present haircutting gauge provides an easy-to-use device which can be quickly and accurately adjusted to any desired hair length. The actions required to position the gauge accurately are simple and natural, with the result that repetitive cuts may be made at any desired length with confidence. The resulting haircut presents a well trimmed appearance with a minimum of practice.

DESCRIPTION OF THE PREFERRED EMBODIMENTS

Figure 1:
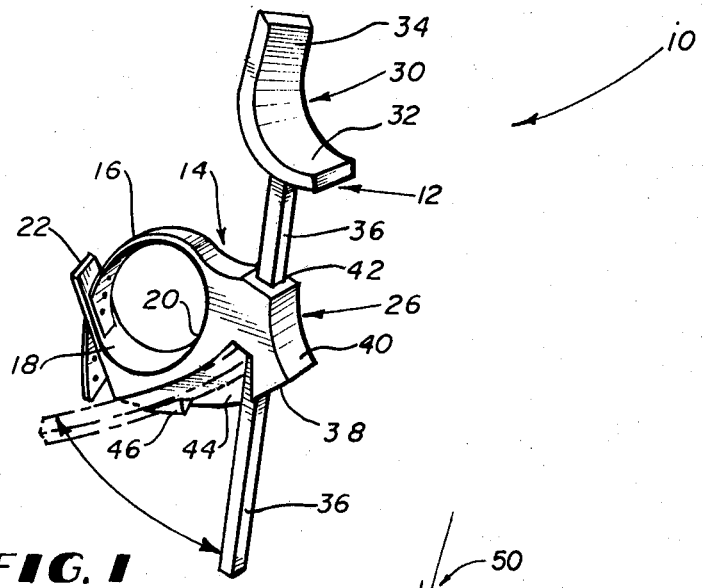
FIG. 1 is a perspective view of the hair cutting gauge of the present invention.

The hair gauge 10 basically comprises two parts, namely, a finger saddle member 12 and a thumb ring member 14. The thumb ring 14 preferably is made from a plastic material and, more preferably, from a fairly flexible plastic material such as polyethylene or polypropylene, and may be most easily formed by injection molding. A pair of flexible strap members 16 and 18 extend from either side of curved portion 20 of the ring member 14, and may be adjustably fastened together by any suitable means such as a molded-in-buckle 22 or similar means, thereby forming a ring suitable for adjustment to different sizes of thumbs. A projection 26 extends from one side of the ring member 14.

The finger saddle member 12 preferably is formed from a similar material and in a similar manner to the thumb ring member 14. The finger saddle portion 30 is shaped so as to form a rest 32 fitting a finger and an upward extension 34 preferably extending from rest 32 a distance approximately equal to the thickness of a finger. The rest 32 is attached to an elongated stem 36 which preferably is made as long as the longest hair that it is to be cut. The stem 36 preferably has a polygonal cross section e.g., the square cross section shown in the drawing, and preferably is stiff enough to support several ounces of weight without bending and capable of being bent by the application of moderate pressure laterally.

The projection 26 of the thumb ring member 14 has a first side 38 forming a generally flat base and a second side 40 disposed in generally perpendicular relation to the first side 38. A hole 42 extends through the projection 26 generally parallel to the second side 40. The hole 42 is formed so as to provide a sliding friction fit for the stem 36 of the finger saddle member 12. A notch 44 is formed in the first side 38 which exposes approximately half of the length of the stem 36 extending through the projection 26. The notch 44 extends from the hole 40 along the entire length of the first side 38 of projection 26. A lug 46 preferably is left projecting into the area of the notch 44 in approximately parallel relation to the first side 38. The lug 46 is so shaped that the stem 36 may be bent through the notch 44 after passing through the hole 42 and snapped behind the lug 46, thereby locking the stem 36 in any desired position.

Figure 2:
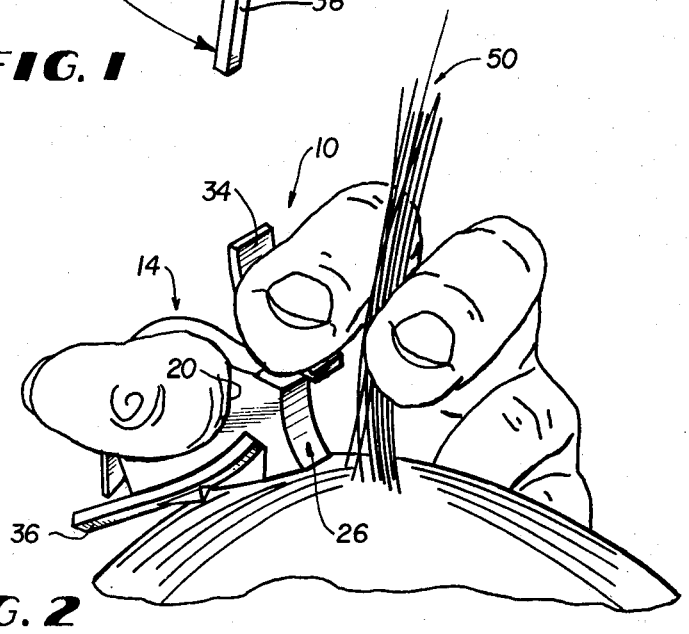
FIG. 2 is a perspective view of the hair cutting gauge in use in a typical manner.
Figure 3:
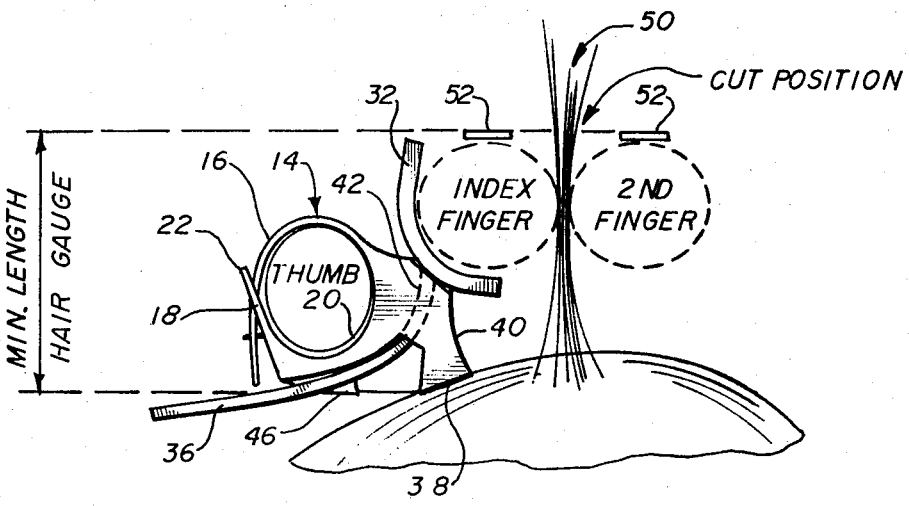
FIG. 3 is a front elevational view of the hair cutting gauge in use in a typical manner.

In use, as seen in FIGS. 2 and 3, the thumb ring member 14 is snugly attached to the thumb of the hand used for holding hair to be cut by means of the straps 16 and 18. The left hand is illustrated. The projection 26 is placed on the side of the thumb that faces the scalp with the first side 38 in generally parallel relation to the palm of the hand. The stem 36 of the finger saddle member 12 is inserted into the hole 42 with the rest 32 in a position to fit under the index finger as illustrated in FIG. 3. The stem 36 is moved through the hole 42 until the distance between the base side 38 of the projection 26 and the tip of the extension 34 is equal to the length of hair that is desired. The portion of the flexible and resilient stem 36 that extends into the notch 44 is then bent over and locked behind the lug 46.

A lock of hair 50 is then drawn between the index and middle fingers until the finger rest 32 may be placed under the index finger with the base side 38 of the projection 26 in contact with the scalp of the head at the base of the lock of hair 50. Scissors 50 can then be used in the opposite hand to cut the portion of the lock of hair 50 extending beyond the index and middle fingers.

Different lengths of hair on different portions of the head may be successively cut by adjusting the effective length of the stem 36 extending from the hole 42 in the projection 26. With a little practice, a user of the thumb gauge may cut his or her own hair even where not visible in a mirror with confidence that the resulting haircut will be proportional and shaped as desired.

What is claimed is:

1. A hand-held hair gauge comprising:

support means adopted to fit around the thumb of a user, said support means having a portion engageable with the scalp of a user and an adjustable ring member for receiving a thumb therein, index finger saddle means movably mounted on said support means, and means for releasably retaining said saddle means in a selected position relative to said support means.

2. The hair gauge of claim 1 wherein said ring member comprises a pair of flexible straps, and means for releasably connecting said straps in selected positions to enable the size of said ring member to be varied.

3. A hand-held hair gauge comprising:

support means adapted to fit around the thumb of a user, said support means having a portion engageable with the scalp of a user, index finger saddle means movably mounted on said support means, said saddle means comprising a curved rest portion for engagement with an index finger and a stem portion connected to said rest portion, and means for releasably retaining said saddle means in a selected position relative to said support means.

4. The hair gauge of claim 3 wherein said support means has an aperture extending therethrough, and said stem portion is slidably mounted in said aperture.

5. The hair gauge of claim 4 wherein said stem portion is formed of a flexible and resilient material, and said retaining means comprises a lug on said support means, said stem portion being deformable into releasable engagement with said lug to retain said rest portion in a desired position relative to said support portion.

6. The hair gauge of claim 5 wherein said support portion has a notch through which said stem portion is deformable into engagement with said lug.

7. The hair gauge of claim 5 wherein said support means, said saddle means and said retaining means are formed of a plastic material.

* * * * *